United States Patent [19]

Carpinella et al.

[11] Patent Number: 5,042,764

[45] Date of Patent: Aug. 27, 1991

[54] SELF-LEVELING FURNITURE GLIDE

[75] Inventors: Henry J. Carpinella, Waterbury; Ralph Carpinella, Middlebury, both of Conn.

[73] Assignee: Carpin Manufacturing, Inc., Waterbury, Conn.

[21] Appl. No.: 498,999

[22] Filed: Mar. 26, 1990

[51] Int. Cl.[5] ..... F16M 13/00

[52] U.S. Cl. ..... 248/188.2

[58] Field of Search ..... 248/688, 548, 599, 618, 248/622, 628, 632, 633, 634, 635, 677, 188.2, 188.3, 188.8, 188.9; 16/42 R, 42 T; 267/136, 141, 153

[56] References Cited

U.S. PATENT DOCUMENTS

| | | | |
|---|---|---|---|
| Ri. 4,964 | 10/1920 | Anderson | 16/42 R |
| 1,899,395 | 2/1933 | Noelting | 16/42 R |
| 2,860,368 | 11/1958 | Thornsbury | 16/42 T |
| 2,893,164 | 7/1959 | Martin | 248/188.2 |
| 3,738,633 | 6/1973 | Pinezu | 267/141 |
| 4,718,631 | 1/1988 | Reynolds | 248/677 |
| 4,869,479 | 9/1989 | Colonel | 267/141 |
| 4,876,782 | 10/1989 | Carpinella | 269/34 |

FOREIGN PATENT DOCUMENTS

| | | | |
|---|---|---|---|
| 1373593 | 11/1974 | United Kingdom | 16/42 R |

*Primary Examiner*—Ramon O. Ramirez
*Assistant Examiner*—Robert A. Olson
*Attorney, Agent, or Firm*—Chilton, Alix & Van Kirk

[57] ABSTRACT

The free end of each leg of a chair, desk, or table has a glide member secured thereto for resiliently distributing at least the neutral weight of the furniture onto a floor. The glide has a base for contacting the floor and a rivet assembly engaging the chair leg. A cup-like urethane cushion is located between the rivet assembly and the base for transferring the chair load resiliently, thereby deflecting the cushion in the vertical direction commensurate with the load. In alternative embodiments, the cushion is augmented or replaced by a coil spring. Thus, each glide adjusts individually for leveling the piece of furniture.

14 Claims, 2 Drawing Sheets

SELF-LEVELING FURNITURE GLIDE

BACKGROUND OF THE INVENTION

The present invention relates to furniture, and more particularly, to glides secured to the free ends of furniture legs or the like.

It is a common occurence to sit on a chair or at a table, desk or the like, and experience an instability due to the uneven floor surface or differential lengths of the legs. Chairs, desks, tables or similar furniture that is subjected to extensive use, such as in classrooms, cafeterias, conference rooms, and the like, are often fabricated with glides secured to the free ends of the legs to help distribute the weight or load over a larger "footprint" on the floor. Often, such glides have an adjustable overall length, for example, by manually rotating a threaded base portion of the glide relative to a threaded socket portion. Such manual action for adjusting the glide height, i.e., for leveling the desk, is time consuming and cumbersome, and represents considerable effort where a multiplicity of legs are to be frequently adjusted.

SUMMARY OF THE INVENTION

Accordingly, it is an object of the present invention to provide a self-leveling glide for furniture legs, particularly chair, desk, and table legs.

This object is accomplished in accordance with the present invention, by providing a thin walled cushion in the form of a plastic cup, preferably made of urethane, between the base portion of the glide, which rests on the floor, and a rivet assembly which is secured to the free end of the leg, such that the plastic cup resiliently deflects vertically commensurate with the weight or load on the cup.

The cup is preferably in an inverted position such that the open, rim portion rests on the base and the closed portion defines a bearing surface for supporting the rivet assembly. Preferably, the rim portion is substantially cylindrical and the bearing surface is flat and horizontally oriented, with side walls between the rim and the bearing surface angled obliquely inwardly at an angle between about 30–45 degrees.

The cushion member is rigidly supported by the base enough to avoid collapsing under the distributed neutral weight of the piece of furniture yet resilient enough to deflect the fraction of an inch necessary to achieve the leveling effect required under neutral weight. The ability to level without collapsing under positive loads, depends on the material and thickness of the cushion.

In other embodiments, the cushion can be augmented or replaced by a coil spring.

BRIEF DESCRIPTION OF THE DRAWINGS

These and other objects and advantages of the invention will become evident from the following description of the preferred embodiment, keyed to the accompanying drawings, in which.

DESCRIPTION OF THE PREFERRED EMBODIMENT

Figures 1, 2, 3:
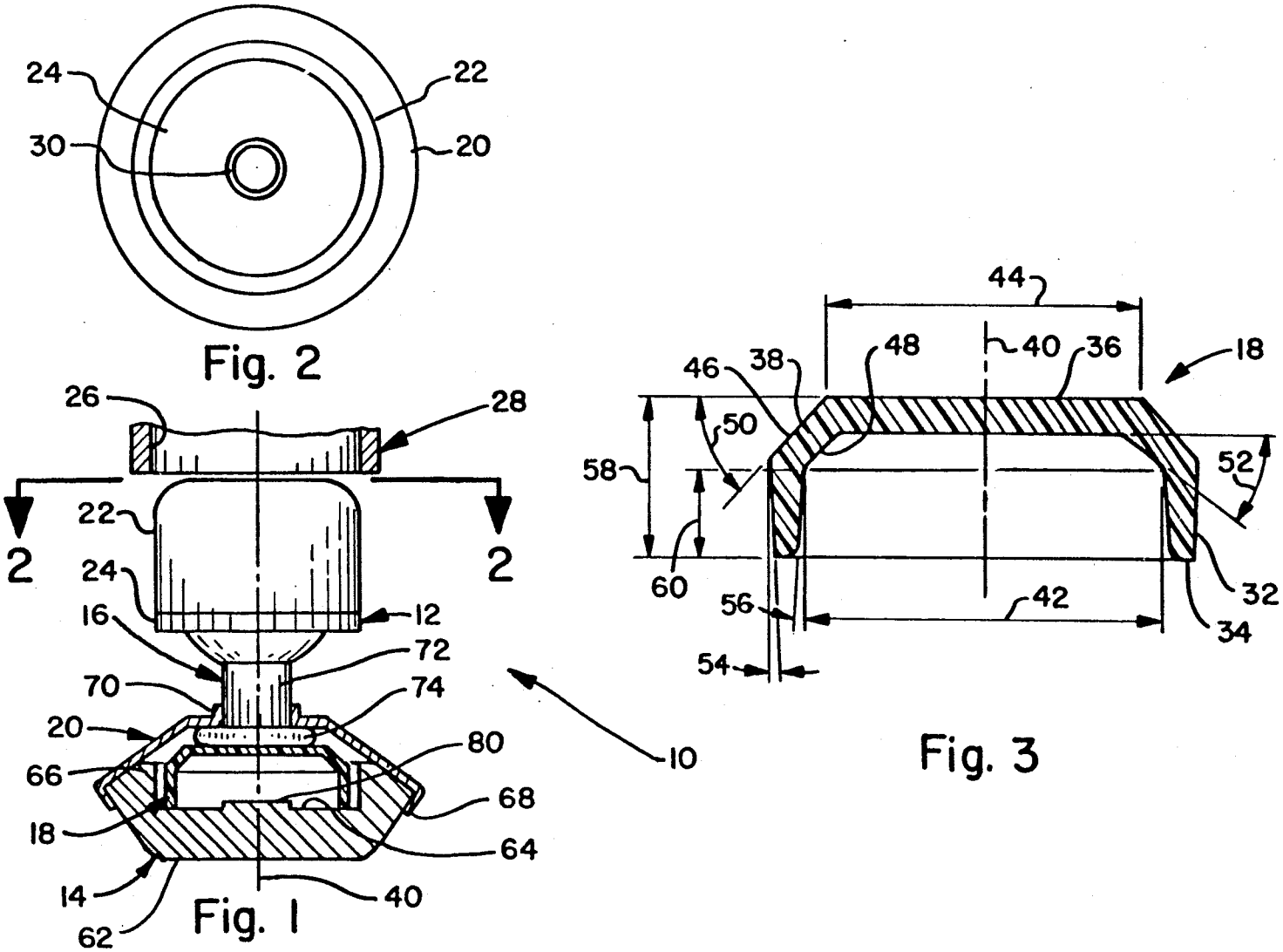
FIG. 1 is an elevation view, partly in section, of a glide member about to be inserted in the free end of a chair leg.
FIG. 2 is a plan view of the chair glide taken along line 2—2 of FIG. 1.
FIG. 3 is a section view of the plastic cushion in accordance with the preferred embodiment of the invention.

FIG. 1 shows a combination 10 in which a furniture glide 12 in accordance with the invention is associated with the free end of leg 28, the glide and leg being joined at the assembly station in a factory by any conventional manner, but preferably as shown in U.S. Pat. No. 4,876,782, "Apparatus for Attaching a Glide to a Chair Leg", the disclosure of which is hereby incorporated by reference.

The glide 12 consists of four main parts, a base 14 for resting on the floor, a shoulder rivet assembly 16 which is secured to the free end of the leg, a cushion member 18 which rests on the upper surface of the base 14 and provides a bearing surface for the lower end of the rivet assembly 16, and an outer shell 20 for retaining the base 14 to the rivet assembly 16 while permitting the rivet assembly 16 to move vertically relative to the base 14 and thereby strain or deflect the cushion 18.

As shown in FIG. 2, the glide as seen from within the tubular wall 26 of leg 28 presents a tubular plug portion 22 which engages the inside or outside of wall 26 in interference relation, a stop plate or support platform 24 which abuts against the lower edge of leg 28, and the outwardly flared head 30 of the tubular end of the neck portion of the rivet piece, which will be described more fully in connection with FIG. 4.

As shown more clearly in FIG. 3, the cushion 18 is preferably in the form of an inverted bowl or cup, with the convex surface facing upward and the concave surface facing downward. More particularly, the preferred shape is symmetric about axis 40, with a substantially cylindrical rim portion 32 extending a distance 60 along the axis and having a free end 34 for resting on the base 14. The substantially flat, solid, circular upper surface 36 acts as a pedestal bearing surface for rivet assembly 16. A side wall 3 extends between the rim 32 and the pedestal surface portion 36. The rim thickness defines a rim inner diameter 42, which should be greater than the pedestal surface diameter 44. The side wall 38 has an outer surface 46 which is angled obliquely toward the axis at about 45 degrees such as shown at 50, and an inner surface 48 that is angled inwardly at about 30 degrees such as shown at 52. Preferably, the height 60 of the rim 32 is at least one-half the overall height 58 of the cushion. It is also preferred that the thickness of rim 32 decreases slightly from the side wall 38 to the free end 34, for example, by about a 2 degrees slope 54 on the outside diameter and a 2 degrees slope 56 on the inside diameter.

It should be appreciated that the cup-like cushion 18 shown in FIG. 3 is a unitary piece, preferably made of urethane or similar non-metal material that is more resilient than other load bearing parts of the glide, but variations from the particular embodiment shown in FIG. 3 may also fall within the scope of the appended claims. The important feature is that the cushion resiliently deflects vertically commensurate with the weight the cushion is required to transfer from the rivet assembly 16 to the base 14. In the illustrated embodiment, neither the rim portion 32 nor the pedestal portion 36 experience a significant bending moment under such loading. Rather, the side wall 38 experiences the greatest stress and the resulting strain is manifested as a vertically downward deflection of the pedestal surface 36. Depending on the expected loading, the cup or cushion 18 could have a relatively short rim, and thus, the cushion would more nearly resemble a bowl. In general, however, the cushion 18 acts as a spring which bears the load imposed by the rivet assembly 16, and resiliently deflects commensurately. Although not preferred, it is possible that a small axial opening could be provided in the pedestal surface 36 without significantly affecting the load bearing and deflection characteristics, but these variations are well within the ability of an ordinarily skilled engineer to optimize through trial and error for a particular application.

With reference again to FIG. 1, the base 14 is preferably made from hard plastic and includes a substantially flat lower surface 62 for resting on the floor, and an upper surface 64 having at least a portion thereof that is flat and parallel to the lower surface 62. The free edges 34 of the cushion 18 rest on the flat portion of the upper surface 64. Preferably, the base 14 includes one continuous, or a plurality of individual, lip members 66 integrally extending above the surface 64 for retaining or positioning the cushion 18 centrally on the base, and for providing attachment points as at 68 for the outer shell 20. The lip member 66 preferably provides a rigid support or backing to limit the radial deformation of the rim 32 of the cushion 18. The base can also include a stop member 80 projecting axially upwardly toward the underside of the pedestal surface, for limiting the deflection thereof and optionally for piloting a coil spring or the like (FIG. 6) between the base surface 64 and pedestal surface 36 to further resiliently support the pedestal surface.

The shell 20 is generally frusto-conical, with the larger open end secured over lips 66 and the other open end 70 telescopically secured to the stem portion 72 of the rivet assembly 16. Preferably, the rivet assembly 16 includes an enlarged flange or pad 74 having substantially the same surface area as the area of pedestal 36, for transferring the load thereto. The smaller diameter end 70 of the shell 20 bears against the shoulder formed between the pad 74 and stem 72. This arrangement retains the base 14 to the rivet assembly 16 and encapsulates the cushion 18 therein. The shell 20 also prevents the accumulation of debris or the like at the interfaces between pad 74 and pedestal surface 36 and between the rim edge 34 and the upper surface 64 of the base 14.

Figure 5:
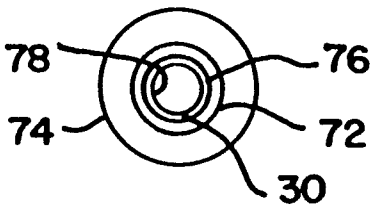
FIG. 5 is a plan view of the rivet member as shown in FIG. 4.
Figure 4:
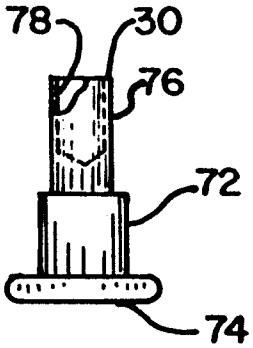
FIG. 4 is an elevation view of a rivet member usable with the present invention.

FIGS. 4 and 5 in conjunction with FIGS. 1 and 2 show additional details concerning the preferred rivet assembly 16. The rivet assembly 16 includes a plug or ferrule 22 and a unitary rivet piece consisting of the pad 74, stem 72, and neck portion 76 which is flared outwardly at 30 for securement to the lower surface of the hollow plug 22. The neck portion 76 has a smooth or optionally threaded bore 78 adapted to be flared outwardly as shown in FIG. 2 or to optionally engage a bolt. In any event, the upper end 30 of the neck is affixed to the plug 22 and extends downward from plug portion 22 and stop plate 24, connecting those components with the piece shown in FIG. 4 to form the overall rivet assembly 16. It should be appreciated, however, that other forms of rivet assembly or their equivalents, are usable in the present invention. Thus, the term "rivet assembly" should be understood to mean any structure which has one end adapted to engage the leg and another end adapted to transfer the load from the leg to the pedestal portion 36 of the cushion 18.

It should be appreciated that the invention could also be implemented, perhaps less easily, if the cup or cushion 18 were oriented with the concave side facing upward and the convex side facing downward. The pad 74 on the rivet assembly 16 would thus have a significantly larger diameter, i.e., at least the diameter of the cushion rim.

Figure 6:
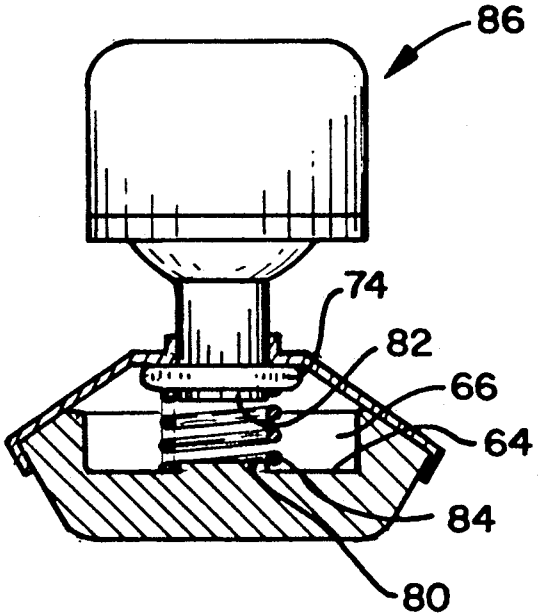
FIG. 6 is an elevation view, partly in section, of another embodiment wherein the cup-shaped cushion has been replaced with a coil spring.

Another embodiment of the invention, which takes advantage of the overall construction of the glide but does not rely on the resiliency of the urethane cushion, relies rather on the resiliency of a coil spring 84, as shown in FIG. 6. With respect to the embodiment of FIG. 6, the glide 86 is substantially identical to that of glide 12 shown in FIG. 1, except that the coil spring 84 is interposed between a flat seating surface on the pad 74 and the upper surface 64 of the base. The spring is preferably retained or positioned by a lead-in or pilot structure 82 projecting from the pad 74, in axial opposition to the stop and pilot projection 80 on base upper surface 64. The projections 80,82 not only pilot the spring 84, but also contact each other to limit the deflection of the spring under high loads.

We claim:

1. A self-leveling glide for attachment to the lower end of a furniture leg, comprising:

a base having a substantially flat lower surface and an upper surface including at least a portion that is parallel to the lower surface;

a resilient leveling cushion in the form of an inverted cup defining a rim bearing on said portion of the base upper surface, a pedestal surface spaced from the rim and oriented substantially parallel with said portion of the base upper surface, and a sidewall extending between the rim and the pedestal surface;

a rivet assembly having an upper end which is connectable to the lower end of one of said legs and a flat lower end which bears against the pedestal surface; and means for retaining the base to the rivet assembly while permitting the rivet assembly to move relative to the base, thereby straining the cushion.

2. The glide of claim 1, wherein the cushion is a unitary piece of urethane.

3. The glide of claim 1 wherein the side wall has a thickness which is larger near the pedestal surface than near the rim.

4. The glide of claim 1, wherein the base includes stop means for limiting the strain deflection of the cushion.

5. The glide of claim 1, wherein the base includes at least one lip projecting above said portion of the base upper surface and closely conforming to the rim of the cushion.

6. The glide of claim 1, wherein the means for retaining the base to the rivet includes a substantially frusto-conical shell having a first open end telescopically engaging the rivet and a second open end affixed to the perimeter of the base.

7. The glide of claim 1, wherein the cushion is symmetric about a central axis and has a circular rim defining a rim inner diameter and a circular pedestal surface defining a pedestal diameter that is no larger than the rim inner diameter.

8. The glide of claim 7, wherein the sidewall has inner and outer sides, the inner side oriented at an angle of about 30 degrees to the axis and the outer side oriented at an angle of about 45 degrees to the axis.

9. The glide of claim 7, wherein the rim is substantially cylindrical about the axis and said rim inner diameter is the inner diameter of the cylinder, and said side wall extends obliquely inwardly at an angle toward the axis from the rim to the pedestal surface.

10. The glide of claim 9, wherein the oblique angle is between about 30–60 degrees.

11. The glide of claim 7, wherein the rim is substantially cylindrical about the axis and has a rim thickness defining a rim outer diameter and said rim inner diameter, said rim thickness decreasing from the side wall to contact of the rim with the base upper surface.

12. The glide of claim 11, wherein the rim thickness tapers inwardly with a draft of about two degrees on each of the rim diameters in a direction from the side wall toward the base.

13. A self-leveling glide for attachment to the free end of a furniture leg, comprising:

a base having a substantially flat upper surface and a lower surface for resting on a floor;

a rivet assembly having an upper end which is connectable to the free end of said leg and a lower end having a pad portion spaced from and facing the base upper surface;

resilient means interposed between the base member upper surface and the rivet assembly pad portion, for transmitting furniture weight loads from the leg to the base and deflecting commensurately with the magnitude of the transmitted load; and means for retaining the base to the rivet assembly while permitting the rivet assembly to move relative to the base as the leg is loaded;

wherein the rivet assembly includes, a hollow plug having an open tubular end for engaging said free end of the leg and means for closing the other end of the plug except for an axial bore therein, a rivet piece having one end rigidly secured to the closed end of the plug, the other end of the rivet piece having said pad portion formed thereon and in contact with the resilient means, and a stem portion intermediate the ends of the rivet piece, and wherein said means for retaining fixedly engages the base and telescopingly engages said stem portion.

14. The glide of claim 13, wherein said one end of the rivet piece is tubular, passes through said bore, and is outwardly flared against the closed end of the plug.

* * * * *